US007277075B1

(12) United States Patent
Hirano et al.

(10) Patent No.: US 7,277,075 B1
(45) **Date of Patent: *Oct. 2, 2007**

(54) LIQUID CRYSTAL DISPLAY APPARATUS

(75) Inventors: Satoshi Hirano, Itabashiku (JP); Masaru Yasui, Kobe (JP); Takeo Kamiya, deceased, late of Kobe (JP); Akira Kumiya, legal representative, Anio (JP)

(73) Assignee: TPO Hong Kong Holding Limited, Shatin (HK)

( * ) Notice: Subject to any disclaimer, the term of this patent is extended or adjusted under 35 U.S.C. 154(b) by 708 days.

This patent is subject to a terminal disclaimer.

(21) Appl. No.: 09/889,090

(22) PCT Filed: Nov. 10, 2000

(86) PCT No.: PCT/EP00/11250

§ 371 (c)(1),
(2), (4) Date: Jun. 26, 2002

(87) PCT Pub. No.: WO01/37249

PCT Pub. Date: May 25, 2001

(30) Foreign Application Priority Data

Nov. 12, 1999 (JP) ..... 11/321901

(51) Int. Cl.
*G09G 3/36* (2006.01)
*G09G 3/10* (2006.01)

(52) U.S. Cl. ..... 345/89; 345/88; 345/690

(58) Field of Classification Search ..... 345/87–89, 345/90–98, 204, 690–694, 214, 589–597; 348/655, 690, 234, 396.1; 358/516; 382/162–168
See application file for complete search history.

(56) References Cited

U.S. PATENT DOCUMENTS 5,929,843 A * 7/1999 Tanioka ..... 345/600

FOREIGN PATENT DOCUMENTS

EP 0541295 A2 10/1992
EP 0541295 A2 5/1993

OTHER PUBLICATIONS

Japanese Patent Application Laid-Open No. 10998/1998.
Patent Abstracts of Japan, vol. 1995, No. 9, Oct. 1995 & JP 07 152144 A (NEC Corp) ,Jun. 1995, Abstract.

* cited by examiner

*Primary Examiner*—Richard Hjerpe
*Assistant Examiner*—Duc Dinh
(74) *Attorney, Agent, or Firm*—Birch, Stewart, Kolasch & Birch, LLP

(57) ABSTRACT

In an RGBW-type liquid crystal display device, luminance is improved by the addition of W sub-pixels while an image is displayed without any change in chromaticity of half-tones. Digital corrected values of red, green and blue are obtained by adding a predetermined digital value for driving a W sub-pixel to each of RGB digital values which correspond respectively to pixels of an acquired image. A converting calculation is effected on the digital corrected values such that the ratio of these digital corrected values for red, green and blue is made equal to the ratio of the red, green and blue digital values corresponding to the pixels of said acquired image. The RGBW sub-pixels are driven with the converted values and the predetermined digital value of driving W sub-pixel to thereby display an image.

17 Claims, 4 Drawing Sheets

LIQUID CRYSTAL DISPLAY APPARATUS

This invention relates to a liquid crystal display apparatus capable of displaying color images.

In recent years, liquid crystal display apparatuses capable of displaying color images have been widely used as display apparatuses, for example, for personal computers, video cameras and car navigation systems.

A Liquid crystal display apparatus of the RGBW type (hereinafter referred to as "an RGBW-type liquid crystal display apparatus"), on which a transparent filter (W) is arranged in addition to an RGB filter of the conventional RGB type, has been proposed in Japanese Patent Application Laid-open No.10998/1998 as a method for improving luminance of pixels of a liquid crystal panel of such liquid crystal display apparatus.

However, even if the transparent filter is added in order to improve luminance, the ratio of red, blue and green of the original image will be changed, since the white color is mixed in all display colors. As a result, the color purity (color saturation) of a displayed image is reduced with respect to the original image, so that a chromaticity will be changed, in particular, in halftones.

Accordingly, an object of the invention is to provide an RGBW-type liquid crystal display apparatus in which a chromaticity is not changed even in halftones, by adding a white component to a red component, a green component and a blue component of an original input image for improving luminance thereof and thereafter further converting the ratio of these red, green and blue components after the addition of the white component into the ratio of the red, green and blue components of the original image to drive each RGBW sub-pixel.

In the liquid crystal display apparatus according to the invention, the chromaticity of halftones of the original image will not change even when a white component is added to each component of red, blue and green colors of the original image to improve the luminance, thus the above object being achieved.

These and other aspects of the invention are apparent from and will be elucidated with reference to embodiments described hereinafter with reference to the accompanying drawings, in which.

These Figures are diagrammatic and not to scale, and wherein corresponding components are generally denoted by the same reference numbers.

A preferred embodiment of a liquid crystal display apparatus according to the invention will now be described.

Figure 1:
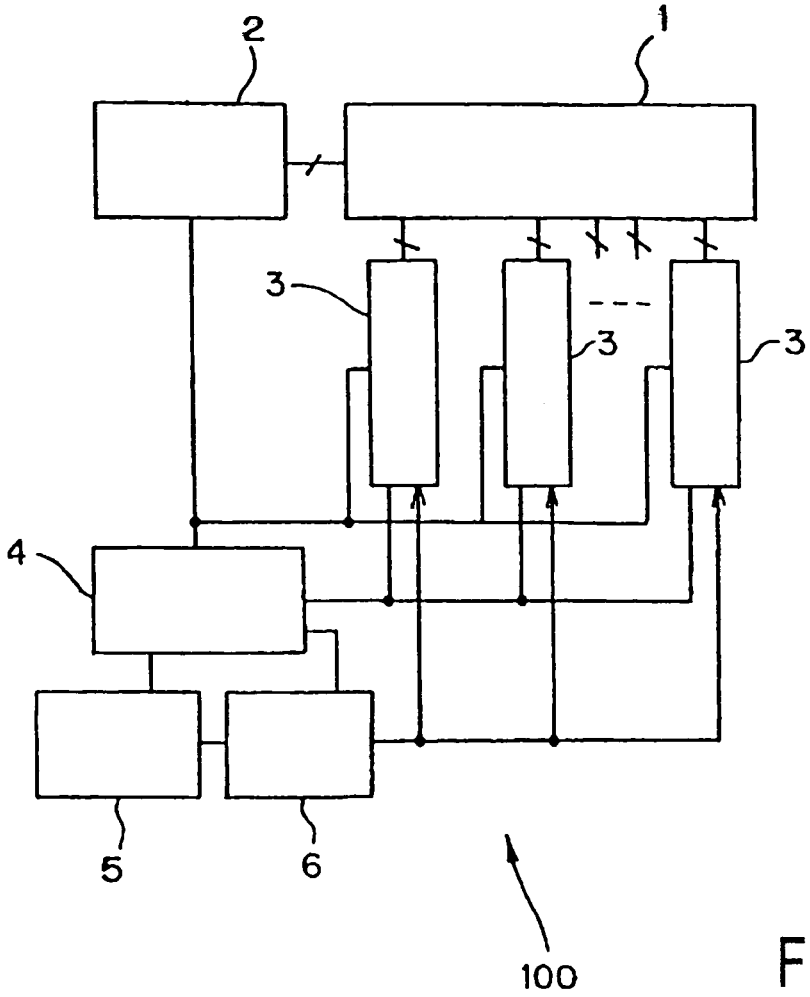
FIG. 1 is a block diagram showing the constitution of a liquid crystal display apparatus 100 according to a preferred embodiment of the invention.

FIG. 1 is a block diagram showing the constitution of a liquid crystal display apparatus 100 according to an embodiment of the invention. This liquid crystal display apparatus 100 is provided with a liquid crystal panel 1.

Figure 2:
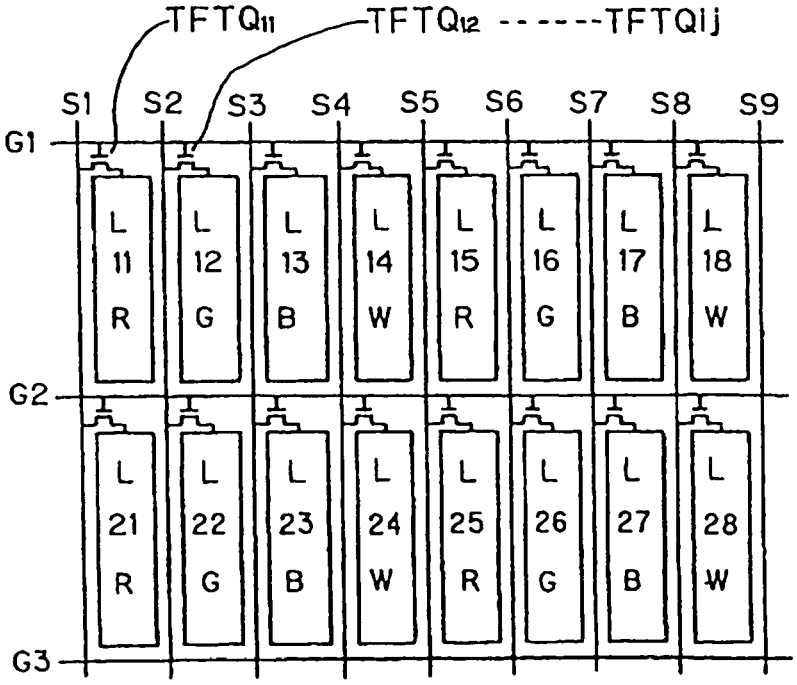
FIG. 2 is a top plane view of the liquid crystal panel 1 of FIG. 1, in which the arrangement of sub-pixels, gate buses and source buses are illustrated.

FIG. 2 is a top plane view of this liquid crystal panel 1 in which a horizontal cross-section of the panel is schematically shown.

This liquid crystal panel 1 is provided with gate buses G1 to Gm (m: a natural number) each extending in a row direction and source buses S1 to Sn (n: a natural number) each extending in a column direction as shown in FIG. 2. The gate buses G1 to Gm are connected to a gate driver 2, and the source buses S1 to Sn are connected to source drivers 3.

A sub-pixel Lij of R (red), G (green), B (blue) or W (white) is disposed within each area defined by the gate buses Gi and G1+1 (i=1 to m) and the source buses Sj and Sj+1 (j=1 to m).

A TFT (thin film transistor) Qij is arranged in the vicinity of each intersection of the gate bus Gi and the source bus Sj.

Furthermore, the gate bus Gi is connected to a gate of the TFT Qij, the source bus Sj to a source of the TFTQij, and a display electrode of the sub-pixel Lij to a drain of the TFT Qij.

Opposed to the display electrode of each sub-pixel Lij is a common electrode which is connected to a common voltage supply circuit (not shown).

When the sub-pixels are arranged in the form of vertical stripes as shown in FIG. 2, color filters for RGBW are arranged in the following manner with respect to each sub-pixel Lij, wherein one pixel is constituted by four sub-pixels of RGBW.

| | |
|---|---|
| R:Lij (i = 1, 2, 3, . . . , m-1; | j = 1, 5, 9, . . . , n-3) |
| G:Lij (i = 1, 2, 3, . . . , m; | j = 2, 6, 10, . . . , n-2) |
| B:Lij (i = 1, 2, 3, . . . , m; | j = 3, 7, 11, . . . , n-1) |
| W:Lij (I = 1, 2, 3, . . . , m-1; | j = 4, 8, 12, . . . , n) |

In this liquid crystal panel 1, a TFT substrate (not shown) on which the sub-pixel electrodes are formed, a color filter substrate on which the common electrode is formed and a glass substrate or the like are arranged in a direction perpendicular to a surface of the panel and a liquid crystal is filled in a space between the substrates.

The description of the liquid crystal display apparatus 100 will be continued with reference to FIG. 1 again.

The gate driver 2 and the eight source drivers 3 are arranged around the liquid crystal panel 1. Each source driver 3 comprises amplifiers, DACs (DA converters) and latches, all of which are not shown. A decoder 6 is connected to the eight source drivers 3. This decoder 6 is connected to an image data holding section 5 for converting an input signal to digital data, and receives therefrom eight-bit sub-pixel data of the acquired image.

This liquid crystal display apparatus 100 further comprises a signal control section 4. This signal control section 4 feeds a power supply voltage to the gate driver 2 and the source drivers 3, and supplies control signals to the gate driver 2 and the source drivers 3.

The liquid crystal display apparatus 100 also comprises a reference potential generating circuit (not shown) for applying a reference potential to each source driver 3.

The operation of the liquid crystal display apparatus 100 shown in FIG. 1 will be described below.

The control signals are supplied from the signal control section 4 to the gate driver 2 and the respective source drivers 3. The gate driver 2 transmits, based on the control signal, to the respective gate buses (refer to FIG. 2) signals for turning TFTs Qij into the on condition.

When the control signal is supplied to each source driver 3, a latch portion (not shown) of each source driver 3 latches, based on the above control signal, eight-bit sub-pixel data (hereinafter referred to as "sub-pixel output luminance data Ro, Go, Bo and Wo") which have been obtained by the decoder 6 as signals for RGBW sub-pixels by performing a predetermined calculation (described later) on the data of image data RGB (hereinafter referred to as "sub-pixel input data Ri, Gi, and Bi") constituting the digital image as held in the image data holding section 5.

The sub-pixel data latched in the latch portion are sequentially supplied to a DAC portion (not shown). The signal control section 4 also outputs a polarity control signal for controlling whether the DAC portion selects a potential from the positive polarity reference potential generated by the reference potential generating circuit or a potential from the negative polarity reference potential generated by the reference potential generating circuit. This polarity control signal is input to the DAC portion. The DAC portion selects, based on the input polarity control signal and the sub-pixel output luminance data, a potential from the potential generated by the reference potential generating circuit which corresponds to the RGBW sub-pixel output luminance data.

When a potential is thus selected in the DAC portion, the DAC portion divides a voltage of the selected reference potential by a resistance division into appropriate steps so as to obtain a desired gradation. Thereafter, the divided voltage is current-amplified by an amplifier (not shown) and transmitted to a corresponding one of the source buses S1 to Sn (refer to FIG. 2). When TFTs are rendered on by a signal transmitted to any one of the gate buses G1 to Gm, the signal transmitted to the source bus and representing the potential is transferred through the above TFT to the corresponding pixel electrode.

In this manner, a potential corresponding to the sub-pixel data is given to each sub-pixel electrode. Therefore, a voltage is applied to each portion of the liquid crystal layer which is sandwiched between the common electrode and a respective one of the sub-pixel electrodes, so that the liquid crystal layer is driven in accordance with the potentials applied to the respective sub-pixel electrodes, whereby an image is displayed on the liquid crystal panel 1 in accordance with the principle of additive color mixing.

A preferred embodiment of the calculation processing performed in the above-described decoder 6 will now be described with reference to FIGS. 3(*a*) and 3(*b*) and mathematical formulas (1) to (5).

Figure 3A:
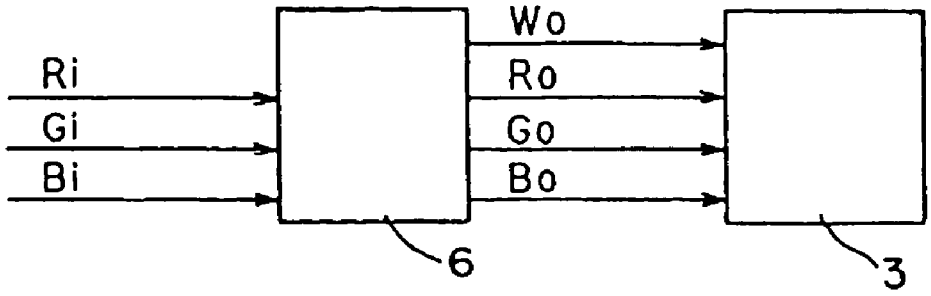
FIG. 3 is a block diagram schematically illustrating a source driver 3 and a decoder 6 shown in FIG. 1.
Figure 3B:
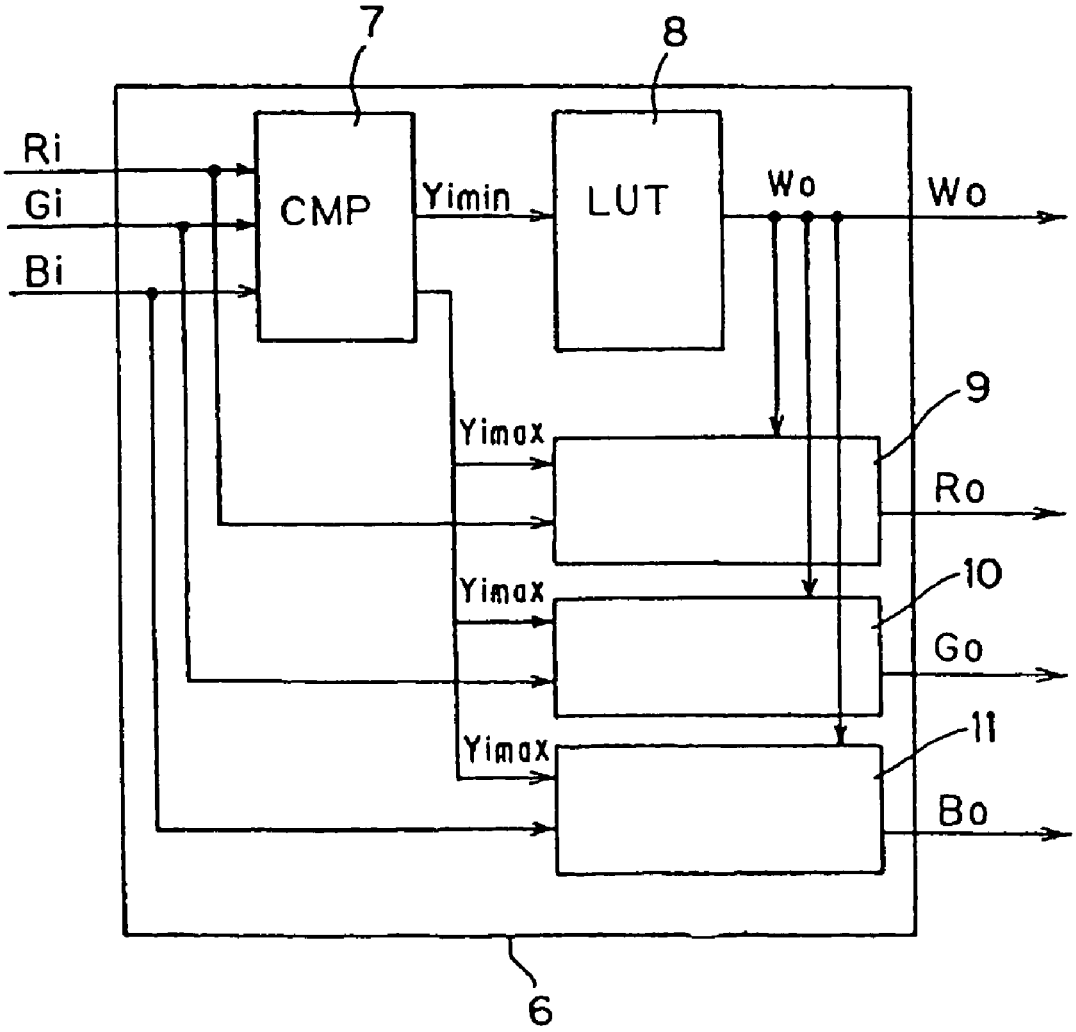

As shown in FIG. 3(*a*), the decoder 6 has a function of receiving the sub-pixel input data Ri, Gi, and Bi from the image data holding section 5 (FIG. 1), obtaining from these data the luminance data Wo for the luminance-enhancing sub-pixel and the sub-pixel output luminance data Ro, Go, Bo and Wo by calculation, and outputting these data to the source driver 3. Alternatively, the decoder 6 may be arranged to receive the sub-pixel input data Ri, Gi, and Bi from the image data holding section 5, to convert the data into values in the luminance dimension and then to perform the calculation.

In general, there is a relationship $Y=kDig^{2.2}$ (k is a constant of proportion) between a digital value Dig (an digital input data) and luminance Y in a display for a computer. In the calculation processing according to the present embodiment, a calculation which will be described later can also be performed using this luminance dimension.

However, by the conversion into such luminance dimension an eight-bit digital signal will become a value of the order of 16 bits, and as a result, a circuit to be used will become more sophisticated and large, whereby the cost will be increased.

For this reason, the calculation may be performed on the digital value, as it is, without any conversion of the above dimension in order to simplify the circuit. Even if the calculation is simplified, the influence on the quality of the displayed image will not be so large as to cause any trouble, and the quality may be acceptable in the practical use. Moreover, various calculation formulas according to the invention described herein can be explained based on the same principles regardless of the dimension of each data of red, blue and green.

Accordingly, the digital input value would be used as it is for the sake of simplify in the following description of the embodiment.

The internal structure and the operation of the decoder 6 will be described with reference to FIG. 3(*b*).

The decoder 6 is provided with a comparator 7, a look-up table 8, a red calculating circuit 9, a blue calculating circuit 10 and a green calculating circuit 11 as shown in FIG. 3(*b*).

The comparator 7 receives sub-pixel input data Ri, Gi, and Bi from the image data holding section 5 and then compares magnitudes of the data values of Ri, Gi and Bi to one another. The comparator 7 then obtains the maximum and minimum values of the data values of Ri, Gi and Bi as its comparison results, and outputs the minimum value to the look-up table 8 as Yimin and outputs the maximum value to the red calculating circuit 9, the blue calculating circuit 10 and the green calculating circuit 11 as Yimax.

The look-up table 8 receives the above minimum value Yimin and converts it into luminance data Wo for the luminance-enhancing sub-pixel.

This conversion in the look-up table 8 is performed by using PROM in which calculation results of a function Wo=f(Ymin) for each value of a variable Yimin are stored in addresses for Yimin, wherein Yimin ranges from zero to 255 when each sub-pixel is expressed in 256-step gradation. Alternatively, this conversion may be performed using a calculating circuit.

On the other hand, each of the red calculating circuit 9, the blue calculating circuit 10 and the green calculating circuit 11 performs a calculation according to a respective one of the following formulas with a respective value of data of the Ri, Gi, and Bi, the Yimax value and the Wo value:

mathematical formula (1): Ro=Ri*(Wo+Yimax)/Yimax−Wo;

mathematical formula (2): Go=Gi*(Wo+Yimax)/Yimax−Wo; and mathematical formula (3): Bo=Bi*(Wo+Yimax)/Yimax−Wo;

(hereinafter referred to simply as "the mathematical formula (1)", "the mathematical formula (2)", and "the mathematical formula (3)", respectively) to thereby obtain a respective one of the sub-pixel output luminance data Ro, Go and Bo.

The decoder 6 then outputs these RGB sub-pixel output luminance data Ro, Go and Bo to the source drivers 3 together with Wo.

The above-described mathematical formula (1) is a formula obtained by modifying mathematical formula (4): Ri/Yimax=(Ro+Wo)/(Yimax+Wo) (hereinafter referred to simply as, "mathematical formula (4)").

More specifically, the mathematical formula (4) is a relational expression for the purpose that the ratio between the data values Ri, Gi and Bi can be made equal to the ratio between the values obtained by adding Wo to the respective data Ro, Go and Bo, when the sub-pixel output luminance data Ro, Go and Bo for the RGB sub-pixels are obtained by adding the sub-pixel output luminance data Wo for the W sub-pixel to the RGB sub-pixel input luminance data Ri, Gi, and Bi.

Similarly, the mathematical formula (2) is a formula obtained by modifying mathematical formula (5): Gi/Yimax=(Go+Wo)/(Yimax+Wo), and the mathematical formula (3) is a formula obtained by modifying mathematical formula (6): Bi/Yimax=(Bo+Wo)/(Yimax+Wo), (hereinafter referred to simply as "mathematical formula (5)", and "mathematical formula (6)", respectively).

For the chromaticity of the image which is formed by the liquid crystal panel 1, the following effects can be obtained by driving the source drivers 3 with the RGB sub-pixel output luminance data Ro, Go and Bo and the sub-pixel output luminance data Wo for the W sub-pixels which have been obtained by the above mathematical formulas 1 to 3.

For example, when the above function Wo=f(Ymin) is represented by mathematical formula (7): Wo=Yimin (hereinafter referred to simply as, "mathematical formula (7)"), the minimum value of Ri, Gi and Bi is selected as the value Wo. As a result, when at least one of the values Ri, Gi and Bi is zero, Wo=0 is established.

In this case, Ro=Ri, Go=Gi and Bo=Bi are obtained according to the mathematical formulas (1) to (3). Accordingly, the chromaticity does not change in this case.

Moreover, according to the mathematical formulas (1) to (3), the ratio between the data values Ri, Gi and Bi is equal to the ratio between the values obtained by adding Wo to the respective data Ro, Go and Bo, so that the ratio between the colors does not change, as a result the chromaticity does not change even in the halftones.

As a specific example, the embodiment (an example of operation) of the decoder 6 will be described for the case of Ri=240, Gi=160 and Bi=120 with reference to FIG. 4.

First, the comparator 7 receives Ri=240, Gi=160, and Bi=120 as its input data from the image data holding section 6 and determines from Ri=240, Gi=160 and Bi=120 that the minimum value is 120 and the maximum value is 240, with the result that Yimin=120, Yimax=240.

The look-up table 8 determines Yimin=120, which is output from the comparator 7, to be Wo value (here, the case where the value Wo=f(Yimin) is represented by the mathematical formula (7) is taken as an example).

Figure 4A:
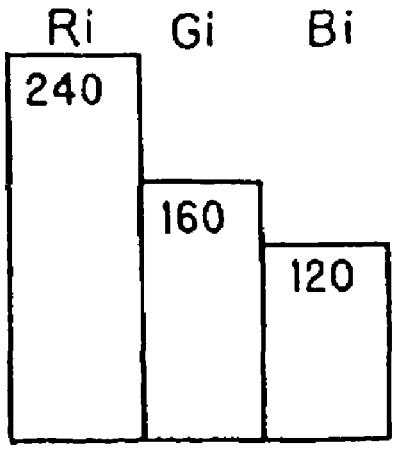
FIG. 4 is an illustration which explains the function of the preferred embodiment.
Figure 4B:
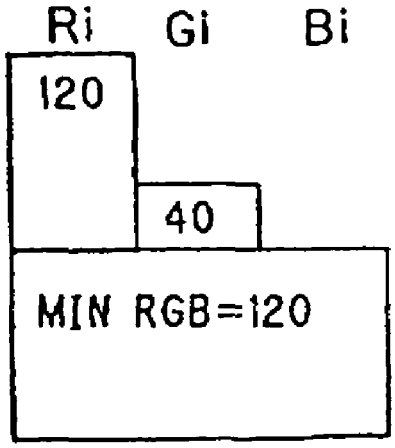
Figure 4C:
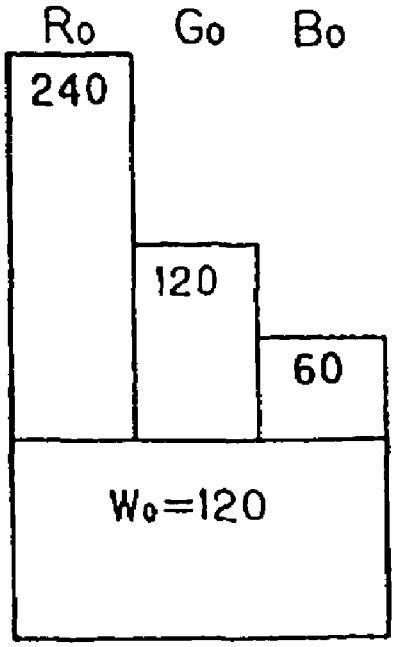

Finally, the values of Yimin=120 and Yimax=240 and Wo=120 output from the comparator 7 and the look-up table 8, and the values of the RGB sub-pixel input luminance data Ri=240, Gi=160, and Bi=120 are substituted into the mathematical formulas 1 to 3 by the calculating circuits 9 to 11, respectively, whereby the RGBW sub-pixel output luminance data Ro=360, Go=240 and Bo=180 are obtained (refer to FIG. 4(*c*)).

As is apparent from this result, according to the calculations by the mathematical formulas 1 to 4, Ri:Gi:Bi=240:160:120=6:4:3 are obtained and Ro:Go:Ro=360:240:180=6:4:3 are obtained. Thus, it will be understood that the relation of Ri:Gi:Bi=Ro:Go:Ro is satisfied.

Since the ratio of RGB of the output luminance data will not differ from the ratio of RGB of the input data even when Wo is added in order to improve luminance, the chromaticity (color saturation) of the halftones will not be degraded. It is needless to say that the relation represented by the mathematical formulas (4) to (6) is also satisfied even in the case where the digital value of each variable is converted into the dimension of luminance for the reason mentioned above.

More specifically, when the digital value Ri, Gi, and Bi for the red input sub-pixel, the green input sub-pixel and the blue input sub-pixel obtained from the input image are converted into RI, GI and BI as the values having the dimension of luminance, and the luminance values for the red output sub-pixel, the green output sub-pixel, the blue output sub-pixel and the luminance-enhancing sub-pixel are represented as RO, G0, BO and WO, the relation of RI:GI:BI=(RO+WO):(GO+WO):(BO+WO) will be satisfied.

Furthermore, various kinds of modifications can be adopted to the above-described preferred embodiment. Such modifications will now be described.

In the preferred embodiment, although output luminance data for sub-pixel Wo is defined as the value obtained by the function in which the minimum value Yimin of input data for RGB sub-pixel Ri, Gi, and Bi is taken as a variable, a value which is obtained by other functions in accordance with the target optical characteristic (luminance) may also be selected as Wo.

(1) For example, a Wo value which is obtained by a calculating formula represented by Wo=f(Ymin,Ymax) as a function which is monotonously increased as each of these two values Ymin and Ymax increases, or as a function which is monotonously increased as the minimum value Ymin increases with the maximum value Ymax being a constant may also be selected as the function, when the maximum value and the minimum value of the input data Ri, Gi, and Bi for the RGB sub-pixels are Ymax and Ymin, respectively.

(2) When it is desired to emphasize white of maximum luminance, a Wo value which is obtained by a function such as mathematical formula (8): $Wo=255*(Yimin/255)^2$ may also be selected.

(3) When it is desired to brighten the halftones, a Wo value which is obtained by a function such as mathematical formula (9): $Wo=-Yimin^3/255^2+Yimin^2/255+Ymin$ can also be selected.

In the mathematical formulas (8) and (9), Yimin is the minimum value of input luminance data for RGB sub-pixels Ri, Gi, and Bi as in the preferred embodiment.

However, when a Wo value is selected, limits should be defined as will be described below, while satisfying the condition that the ratio between the colors is maintained.

When the maximum value and the minimum value of the input data are Ymax and Ymin, and the maximum value and the minimum value of the output luminance data are Yomax and Yomin, a formula Ymin/Ymax=(Yomin+Wo)/(Yomax+Wo) should be established in order to maintain the ratio between the respective colors, where Yomax=Ymax.

Since the sub-pixel for luminance is added in order to increase luminance, it is desirable that the value of Wo which is given thereto is as large as possible.

To give a value as large as possible to Wo means to replace all the white components in the output data with Wo, with Yomin=0, the formula described above can be modified into Ymin/Ymax=Wo/(Ymax+Wo).

When solving this formula with respect to Wo, the following formula can be obtained: Wo=Ymin*Ymax/(Ymax−Ymin).

In this formula, it is understood that Wo>Ymax can be obtained when Ymin/Ymax>0.5. When Ymax is the maximum value which can be taken (for example, 255 gradation level in the case of eight bits), Wo satisfying Wo>Ymax does not exist.

Therefore, Wo=Ymax is established when Ymin/Ymax>0.5.

In summary, the ratio between the respective colors can be maintained by selecting an optional function so as to satisfy the following relation in order to determine Wo.

When Ymin/Ymax<=0.5, a formula Wo<=Ymin*Ymax/(Ymax−Ymin) can be obtained.

When Ymin/Ymax>0.5, a formula Wo<=Ymax can be obtained.

Figure 5:
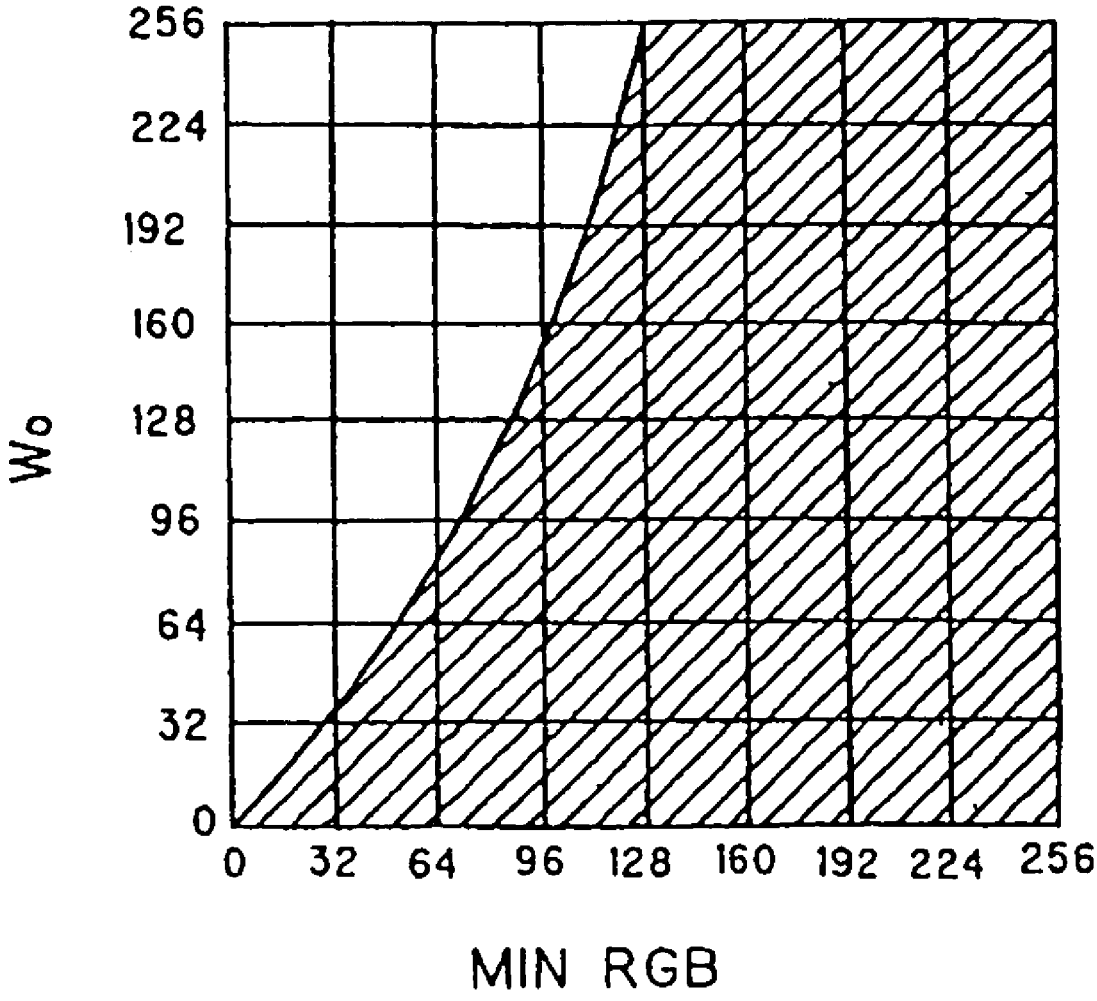
FIG. 5 is a graph which explains a modification of the embodiment.

Although Wo is represented as a function of Ymin and Ymax, since an area of Wo becomes narrower as Ymax becomes larger, the range in which an arbitrary Ymax can be applied is as shown by hatching in FIG. 5. That is to say, this hatched area is the range of values of Wo which can be added for improving luminance while satisfying the condition that the ratio between the respective colors is maintained.

As described above, according to the liquid crystal display device of the invention, the luminance can be improved appropriately without changing the chromaticity of halftones, even when the luminance of the image displayed on the liquid crystal panel is attempted to be enhanced by the white sub-pixels for increasing luminance.

The invention claimed is:

1. A liquid crystal displaying apparatus capable of displaying a color image, comprising:

a liquid crystal panel in which each main pixel unit includes a red sub-pixel, a green sub-pixel, a blue sub-pixel and a luminance-enhancing sub-pixel, and calculation means for calculating digital output values Ro, Go and Bo for driving the red sub-pixel, the green sub-pixel and the blue sub-pixel, respectively, from digital input values Ri, Gi and Bi respectively for the red sub-pixel, the green sub-pixel and the blue sub-pixel and a digital value W for driving the luminance-enhancing sub-pixel so that a relationship of Ri:Gi:Bi=(Ro+W):(Go+W):(Bo+W) is satisfied, the values Ri, Gi and Bi being obtained from an input color image, wherein the digital value W is based on both a maximum value and a minimum value of the digital input values.

2. The liquid crystal displaying apparatus of claim 1, wherein the digital value W monotonously increases as a value of the maximum value or the minimum becomes larger.

3. The liquid crystal displaying apparatus of claim 1, wherein the minimum value is a variable and the maximum value is a constant, and the digital value W monotonously increases as the minimum value becomes larger.

4. A display device comprising:

a plurality of picture elements, each picture element including a plurality of color sub-pixels and a white sub-pixel, a decoder that is configured to receive a plurality of input color values and to produce therefrom a plurality of color luminance pixel values that are used to drive corresponding color sub-pixels, and white pixel values that are used to drive the corresponding white sub-pixels, wherein the decoder is configured to:

determine a minimum color luminance value and a maximum color luminance value for each picture element, produce the color luminance pixel values for each picture element dependent upon the input color values and the maximum color luminance value, and produce the white pixel value for each picture element based on the minimum color luminance value.

5. The display device of claim 4, wherein the decoder is configured to produce the color luminance pixel values for each picture element dependent also upon the white pixel value.

6. The display device of claim 5, wherein the decoder is configured to produce the white pixel value for each picture element dependent also upon the maximum color luminance value.

7. The display device of claim 6, wherein the white pixel value is <=Ymin*Ymax/(Ymax−Ymin) when Ymin/Ymax<=0.5, and the white pixel value is <=Ymax when Ymin/Ymax>0.5, where Ymin, Ymax corresponds to the minimum color luminance value and the maximum color luminance value, respectively.

8. The display device of claim 7, wherein each color luminance pixel value corresponds to Ci*(W+Ymin)/Ymax−W, where Ci, W, Ymin, and Ymax correspond to the input color value, the white pixel value, the minimum color luminance value and the maximum color luminance value, respectively.

9. The display device of claim 4, wherein the decoder is configured to produce the white pixel value for each picture element dependent also upon the maximum color luminance value.

10. The display device of claim 9, wherein the white pixel value is <=Ymin*Ymax/(Ymax−Ymin) when Ymin/Ymax<=0.5, and the white pixel value is <=Ymax when Ymin/Ymax>0.5, where Ymin, Ymax corresponds to the minimum color luminance value and the maximum color luminance value, respectively.

11. The display device of claim 4, wherein each color luminance pixel value corresponds to Ci*(W+Ymin)/Ymax−W, where Ci, W, Ymin, and Ymax correspond to the input color value, the white pixel value, the minimum color luminance value and the maximum color luminance value, respectively.

12. The display device of claim 4, wherein the decoder is configured to provide the color luminance pixel values for each picture element such that a ratio of the color luminance pixel values to each other corresponds to a ratio of the input color values to each other.

13. A method of determining a set of output luminance values for driving sub-pixels of a pixel based on input color values, comprising:

determining a minimum color luminance value and a maximum color luminance value based on the input color values, determining each output color luminance value of the set of output luminance values based on the corresponding input color value and the maximum color luminance value, and determining an output white value of the set of output luminance values based on the minimum color luminance value.

14. The method of claim 13, wherein determining each output color luminance value includes determining each output color luminance value so that a ratio of each output color luminance value to each other corresponds to a ratio of each input color value to each other.

15. The method of claim 13, wherein determining each output color luminance value is also based on the output white value.

16. The method of claim 13, wherein determining the output white value is also based on the maximum color luminance value.

17. The method of claim 13, wherein determining each output color luminance value includes calculating $Co=Ci*(W+Ymin)/Ymax-W$, where Co, Ci, W, Ymin, and Ymax correspond to the output color luminance value, input color value, the white pixel value, the minimum color luminance value and the maximum color luminance value, respectively.

* * * * *